United States Patent [19]

Ketchpel

[11] 4,342,945

[45] Aug. 3, 1982

[54] ELECTROLUMINESCENT THIN FILM DEVICE

[75] Inventor: Richard D. Ketchpel, Santa Barbara, Calif.

[73] Assignee: Rockwell International Corporation, El Segundo, Calif.

[21] Appl. No.: 151,562

[22] Filed: May 20, 1980

[51] Int. Cl.[3] ..... H05B 33/02; H05B 33/22

[52] U.S. Cl. ..... 313/505; 313/509

[58] Field of Search ..... 313/505, 506, 507, 509

[56] References Cited

U.S. PATENT DOCUMENTS 2,874,308 2/1959 Livingston ..... 313/507 X 2,919,366 12/1959 Mash ..... 313/509

*Primary Examiner*—Palmer C. Demeo

*Attorney, Agent, or Firm*—H. Fredrick Hamann; Craig O. Malin; John J. Deinken

[57] ABSTRACT

Disclosed is an electrode for use with thin film devices. An active matrix display incorporating the electrode includes a thin film electroluminescent emitter, an upper dielectric layer deposited on an upper surface of the film, a lower dielectric layer deposited on a lower surface of the film, a plurality of parallel, transparent upper electrodes disposed on the upper dielectric layer, a plurality of parallel lower electrodes disposed on the lower dielectric layer, each lower electrode including an energizing strip disposed sufficiently close to the lower surface to activate the film in conjunction with the upper electrodes, and a coupling strip, spaced sufficiently from the film to resist the effects of electrical breakdown in the film, for connecting the lower electrode to an external component. The display further includes an insulating strip of photoresist separating the coupling strip of each lower electrode from the film and a transparent substrate disposed over the upper electrodes.

9 Claims, 2 Drawing Figures

ELECTROLUMINESCENT THIN FILM DEVICE

BACKGROUND OF THE INVENTION

This invention relates to electrical devices and, more particularly, to electrode structures for thin film devices.

Certain types of materials will emit a narrow wavelength band of radiation as a result of a change in energy states when a sample of the material is excited by an external source of energy. No significant change in the temperature of the material is associated with this phenomenon, which is known as electroluminescence where the luminescence is induced electrically.

One application in which the electroluminescent effect may be used to great advantage is to achieve the video output in a flat panel display system. Such a device can exhibit significant advantages, such as reduced weight and volume, as compared to more conventional cathode ray tube television systems. Furthermore, a flat panel display system is potentially cheaper to produce and can be configured to achieve high reliability under severe operating conditions.

One flat panel display system, for example, has been developed around a miniature active matrix, utilizing a thin film electroluminescent emitter and high density hybrid electronic drivers integrated with the display to produce a miniature video display system. In such a device, a pattern of parallel electrodes is deposited in one direction on a first side of the thin film, and another set of electrodes is applied in an orthogonal direction on a second side of the film. In conjunction, these two sets of electrodes are utilized to provide two dimensional x-y addressing, effectively establishing a matrix of emitter elements. The appropriate elements may then be stimulated to achieve a luminescent picture display.

Some of the properties of an electroluminescent film, however, present difficulties with respect to utilizing such a film to achieve a practical and reliable display device. An electric field applied across such a film can cause sporadic breakdowns of the film at particular locations, which breakdowns can in turn produce a break in the continuity of the overlying electrodes at such locations. When standard electrode deposition techniques are used, for example, these breaks in the electrode can cause the failure of an entire line electrode, resulting in substantial degradation of the image displayed by such a system. Thus, a need has developed for an electrode structure which can be utilized in thin film devices without being subject to failure as a result of point failures in the associated thin film.

SUMMARY OF THE INVENTION

It is a general object of this invention to provide an improved electrode for use with a thin film electrical device.

In a thin film electrical device, including a thin film, a first electrode on a first side of the film, and a second electrode on a second side of the film, a first electrode constructed according to the present invention includes an energizing portion which is disposed sufficiently close to a first surface of the film to activate the film upon the application of an electrical potential between first and second electrodes, and a coupling portion which is spaced sufficiently from the film to resist the effects of electrical breakdowns in the film.

Such a device may further include a plurality of parallel first electrodes disposed on the first side of the film, each first electrode including an energizing portion and a coupling portion, and a plurality of parallel second electrodes disposed on the second side of the film, the second electrodes being disposed perpendicular to the first electrodes.

In a more particular embodiment, the thin film utilized is a thin film electroluminescent emitter.

An active matrix display, according to this invention, includes a thin film electroluminescent emitter, a plurality of parallel, transparent upper electrodes disposed on an upper side of the film, and a plurality of parallel lower electrodes disposed on a lower side of the film and perpendicular to the upper electrodes. Each lower electrode includes an energizing strip disposed sufficiently close to the lower side to activate the film upon the application of an electrical potential between a lower electrode and an upper electrode, and a coupling strip, spaced sufficiently from the film to resist the effects of electrical breakdown in the film.

In a more particular embodiment, the display may further include an insulating strip of photoresist separating the coupling strip of each lower electrode from the film, a transparent substrate disposed over the upper electrodes, an upper dielectric layer deposited on an upper surface of the film, and a lower dielectric layer deposited on a lower surface of the film.

These examples of the more important features of the invention have been broadly outlined in order to facilitate an understanding of the detailed description which follows and so that the contributions which this invention provides to the art may be better appreciated. There are, of course, additional features of the invention, which will be further described below and which are included within the subject matter of the appended claims.

BRIEF DESCRIPTION OF THE DRAWINGS

Additional objects, features, and advantages of the present invention will become apparent by referring to the detailed description of the preferred embodiments in connection with the accompanying drawings, wherein the same reference numerals refer to like elements throughout all the figures. In the drawings.

DESCRIPTION OF THE PREFERRED EMBODIMENT

This invention addresses the problem of electrode breakdown in a thin film electrical device and provides a solution in the form of a novel electrode structure. The significant advantages which this invention provides may be demonstrated by discussing the invention in its application to a particular embodiment of a thin film electrical device, namely, a flat panel display system employing a thin film electroluminescent emitter.

A thin film device capitalizes on the high resolution and non-linear electro-optic response inherent in a thin film electroluminescent emitter. In the particular embodiment discussed here, a thin zinc sulfide film provides the electroluminescent element. Vapor deposited layers of yttrium oxide are established on each side of the film to provide a dielectric region sandwiching the emitter. In this design, etched parallel transparent line electrodes of indium oxide are established on a glass substrate to form a first electrode pattern in one direction. The thin film emitter, in turn, is affixed to the substrate, while a second set of parallel line electrodes is established by applying aluminum to the other side of the thin film in a direction orthogonal to the transparent electrodes. With this structural arrangement, the display is viewed through the glass substrate and the transparent electrodes.

A unique characteristic of this structure is the ability to selectively address an emitter element within the matrix with negligible visible cross-talk from non-addressed intersections. This is due to the highly nonlinear electro-optic response of an electroluminescent emitter. The nonlinear response, in turn, is due to the nature of electron injection into the zinc sulfide phosphor by a tunnel emission phenomenon. The tunnel emission characteristic is relatively independent of temperature so that the display can be operated over a wide temperature extreme. In an x-y matric display an element is energized by placing signals at the appropriate voltage across the row and column elements corresponding to the element location. This also causes non-zero voltages to appear across the non-addressed elements, but this "cross-talk" signal is not a problem with thin film electroluminescent materials because of their nonlinear brightness-voltage characteristic, which allows the x-y matrix to be addressed one line at a time.

Figure 1:
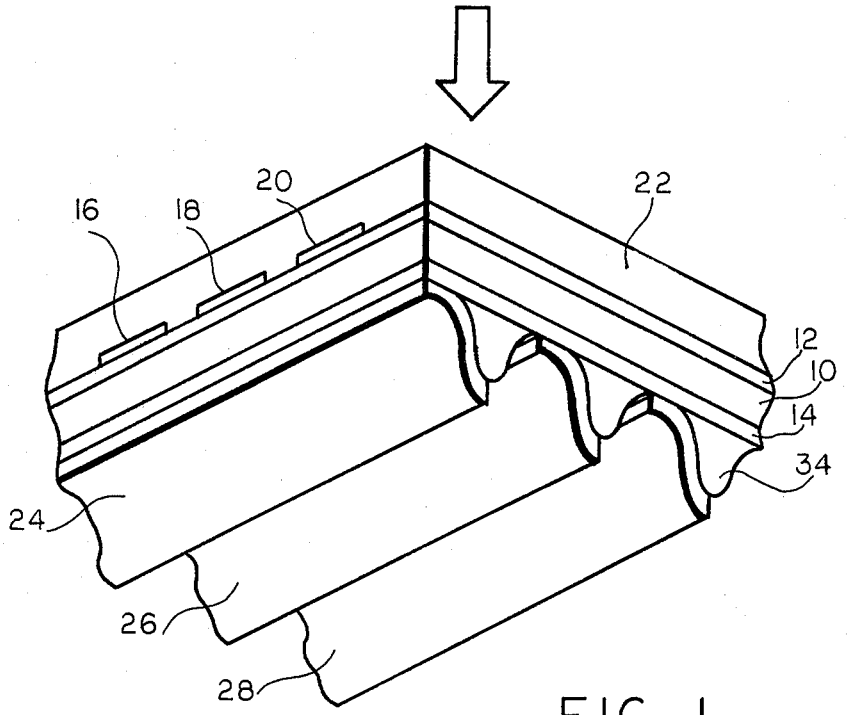
FIG. 1 is a portion of an active matrix display, illustrated in a perspective view.

Now referring to the drawings, illustrated in a perspective view in FIG. 1 is a portion of an active matrix display which incorporates the electrode of the present invention. The display includes a thin film zinc sulfide electroluminescent emitter 10, with upper and lower yttrium oxide dielectric layers 12 and 14, respectively, vapor deposited on the upper and lower surfaces of the film 10. A number of parallel, transparent indium oxide upper electrodes, such as electrodes 16, 18, and 20, are etched onto a glass substrate 22, to which the film 10 is affixed to provide a rigid support for the matrix display. A number of parallel aluminum lower electrodes, such as electrodes 24, 26, and 28, are applied to the lower dielectric layer 14 and oriented so that the lower electrodes are orthogonal to the upper electrodes to provide x-y matrix addressing of the elements of the emitter 10. Although only three of the upper electrodes and three of the lower electrodes are partially shown on that portion of the display which is illustrated in FIG. 1, those skilled in the art will appreciate that a complete display will typically contain a large number of electrodes. A display of approximately one inch square, for example, might contain a 512×683 matrix format, with a corresponding number of upper and lower electrodes.

Figure 2:
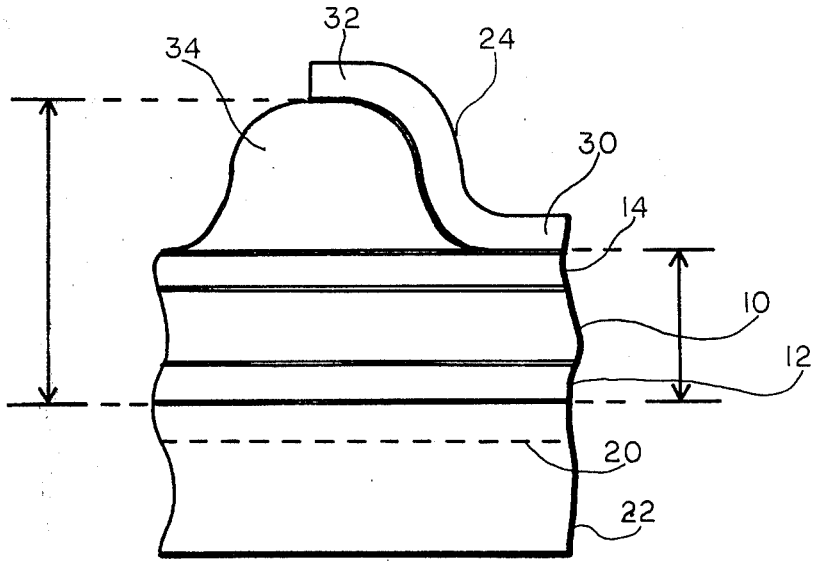
FIG. 2 is a side view of part of the display shown in FIG. 1 illustrating the structure of a single electrode.

The lower electrodes illustrated in FIG. 1 are configured according to the present invention to prevent degradation of the display system due to defects in the thin film 10. The novel structure of the lower electrodes is illustrated in more detail in FIG. 2, which is a side view of a portion of the display shown in FIG. 1, illustrating the structure of the lower electrode 24. The electrode 24 includes an energizing strip 30, which is positioned sufficiently close to the upper electrodes to create an electric field strong enough to activate the film 10, when an appropriate electrical potential is applied between an upper electrode and the lower electrode 24. Contiguous with the energizing strip 30 is a coupling strip 32 which is spaced sufficiently from the film to lower the field strength and thereby resist the detrimental effects of an electrical breakdown in the film. In the embodiment illustrated, support for the coupling strip is provided by an insulating strip 34 of photoresist. Typical dimensions which have been used in embodiments of the invention are a thin film 4500 Å thick, with dielectric layers 12 and 14 each 1800 Å in thickness. Electrodes have been fabricated with the energizing strip 30 less than 2000Å thick, while the coupling strip 32 is increased in thickness to greater than 5000 Å. A photoresist insulating strip 34 has been employed with a typical thickness of 10μ. The need for the electrode of this invention arises out of the physical characteristics of a thin film layer.

When an exposed electrode, such as the electrodes 24, 26, and 28, is fabricated with a refractory forming metal, such as aluminum, titanium, yttrium, or magnesium, a pinhole failure mode may occur where the electrode layer thickness is less than 2000 A. Such a failure might be initiated, for example, by a pinhole blemish in the emitter film 10. The electric field at a blemish will be considerably higher than the operating electric field across the film 10. If these conditions occur on an exposed electrode, an electrical breakdown may result at a pinhole blemish, resulting in the vaporization of the electrode material surrounding the pinhole, leading to an open circuit failure at the pinhole.

Where such a failure occurs in a conventional electrode, the pinhole breakdown can cause a propagating type of short circuit failure in which the electrode material progressively melts down into the plasma discharge of the short circuited area. Experiments have confirmed that such a propagating type of failure can completely consume the electrode in a fraction of a second, rendering an entire line of the display inoperable.

It is an outstanding feature of the present invention to provide an electrode structure which is not susceptible to the propagating mode of failure. The electrode geometry of this invention, such as that of the lower electrode 24, provides a fusible link for any pinhole blemishes which may be present in the emitter film. In the present invention, the energizing strip 30 acts as a fusible link for each emitter element of the film 10, while the coupling strip 32 acts as a parallel bus rail, providing a means to electrically bypass any open portion of the energizing strip 30. The coupling strip 32 is not exposed to the high field at a blemish because of its separation from the film 10 by the insulating layer 34 and because of the dielectric properties of the insulating layer.

A further advantage of the present invention is that with this electrode structure the coupling strip 32 may be made considerably thicker than the energizing strip 30, since an open circuit failure mode is not required in the coupling strip portion of the electrode. Thus the address line current capacity of a device utilizing this invention need not be restricted by failure mode considerations.

With the electrode of this invention, an open circuit failure will be limited to the area of a pinhole blemish, allowing the remainder of the emitter film to continue to operate. Since such blemishes are typically less than about 0.001 inch in diameter, the presence of a localized failure at such a blemish is barely perceptible to the human eye and will have only a negligible effect on the video output of the display. Thus, through the proper selection of electrodes material and thickness, a display which otherwise would have a very limited useful lifetime can be operated for tens of thousands of hours with only a barely perceptible pinhole failure.

In conclusion, although typical embodiments of the present invention have been illustrated and discussed above, numerous modifications and alternative embodiments of the apparatus and method of this invention will be apparent to those skilled in the art in view of this description. The electrode of this invention, for example, may be advantageously applied to thin film electrodes other than the electrodes of a thin film electroluminescent display system, as described above. Accordingly, this description should be considered as illustrative only and is provided for the purpose of teaching those skilled in the art the manner of constructing and using the apparatus of this invention. Furthermore, it should be understood that the forms of the invention depicted and described herein are to be considered as the presently preferred embodiments. Various changes may be made in the configurations, sizes and arrangements of the components of the invention, as will be recognized by those skilled in the art, without departing from the scope of the invention. Equivalent elements, for example, might be substituted for those illustrated and described herein, parts or connections might be reversed or otherwise interchanged, and certain features of the invention might be utilized independently of the use of other features, all as will be apparent to one skilled in the art after receiving the benefit attained through reading the above description of the invention.

What is claimed is:

1. In a thin film electrical device, including a thin electroluminescent film, a plurality of parallel first electrodes on a first side of said film, and a plurality of parallel second electrodes on a second side of said film, each said first electrode comprising:

an energizing portion disposed sufficiently close to a first surface of said film to activate said film upon the application of an electrical potential between said first and second electrodes; and a coupling portion, spaced sufficiently from said film to resist the effects of electrical breakdown in said film.

2. The device of claim 1, further comprising an insulating layer disposed on said first surface and spacing each coupling portion from said first surface.

3. The device of claim 2, further comprising:

a first dielectric layer disposed between said first surface and said first electrodes; and a second dielectric layer disposed between said second side and said second electrodes.

4. An active matrix display, comprising:

a thin film electroluminescent emitter;

a plurality of parallel, transparent upper electrodes disposed on an upper side of said film; and a plurality of parallel lower electrodes disposed on a lower side of said film and perpendicular to said upper electrodes, each lower electrode including an energizing strip disposed sufficiently close to said lower side to activate said film upon the application of an electrical potential between a lower electrode and an upper electrode, and a coupling strip, spaced sufficiently from said film to resist the effects of electrical breakdown in said film.

5. The display of claim 4, further comprising an insulating strip separating the coupling strip of each lower electrode from said film.

6. The display of claim 5, wherein said insulating strips comprise photoresist.

7. The display of claim 4, further comprising a transparent substrate disposed over said upper electrodes.

8. The display of claim 7, further comprising:

an upper dielectric layer deposited on an upper surface of said film; and a lower dielectric layer deposited on a lower surface of said film.

9. An active matrix display, comprising:

a thin film electroluminescent emitter;

an upper dielectric layer deposited on an upper surface of said film;

a lower dielectric layer deposited on a lower surface of said film;

a plurality of parallel, transparent upper electrodes disposed on said upper dielectric layer;

a plurality of parallel lower electrodes disposed on said lower dielectric layer, each lower electrode including an energizing strip disposed sufficiently close to said surface to activate said film upon the application of an electrical potential between a lower electrode and an upper electrode, and a coupling strip, spaced sufficiently from said film to resist the effects of electrical breakdown in said film;

an insulating strip of photoresist separating the coupling strip of each lower electrode from said film; and a transparent substrate disposed over said upper electrodes.

* * * * *